US011532891B2

(12) United States Patent
Fanfelle et al.

(10) Patent No.: US 11,532,891 B2
(45) Date of Patent: Dec. 20, 2022

(54) LOW COST ELECTROMAGNETIC FEED NETWORK

(71) Applicant: Cohere Technologies, Inc., Santa Clara, CA (US)

(72) Inventors: Robert Fanfelle, Santa Clara, CA (US); Richard Benner, Santa Clara, CA (US)

(73) Assignee: Cohere Technologies, Inc., Santa Clara, CA (US)

( * ) Notice: Subject to any disclaimer, the term of this patent is extended or adjusted under 35 U.S.C. 154(b) by 179 days.

(21) Appl. No.: 16/647,436

(22) PCT Filed: Sep. 20, 2018

(86) PCT No.: PCT/US2018/052026

§ 371 (c)(1),
(2) Date: Mar. 13, 2020

(87) PCT Pub. No.: WO2019/060596

PCT Pub. Date: Mar. 28, 2019

(65) Prior Publication Data

US 2020/0280138 A1 Sep. 3, 2020

Related U.S. Application Data

(60) Provisional application No. 62/560,787, filed on Sep. 20, 2017.

(51) Int. Cl.
*H01Q 19/06* (2006.01)
*H01Q 1/48* (2006.01)
(Continued)

(52) U.S. Cl.
CPC ..... *H01Q 19/062* (2013.01); *H01Q 1/48* (2013.01); *H01Q 9/28* (2013.01); *H01Q 15/02* (2013.01); *H01Q 21/26* (2013.01)

(58) Field of Classification Search
CPC ..... H01Q 15/02; H01Q 19/06
See application file for complete search history.

(56) References Cited

U.S. PATENT DOCUMENTS 4,754,493 A 6/1988 Coates
5,083,135 A 1/1992 Nagy et al.
(Continued)

FOREIGN PATENT DOCUMENTS

CN 1235720 A 11/1999
CN 101682316 A 3/2010
(Continued)

OTHER PUBLICATIONS

Extended European Search Report for European Application No. 18858314.0, dated May 21, 2021, 10 pages.
(Continued)

*Primary Examiner* — Hasan Islam
(74) *Attorney, Agent, or Firm* — Perkins Coie LLP

(57) ABSTRACT

An antenna system includes a lens portion that has a spherical surface, and an antenna feed structure coupled to a surface of the lens portion. The antenna feed structure includes one or more feed tiles supported by an electrical connectivity layer conforming to the spherical surface. The antenna system also includes one or more offset structures positioned between the one or more feed tiles and an outer surface of the antenna system.

21 Claims, 6 Drawing Sheets

(51) Int. Cl.

| | |
|---|---|
| ***H01Q 9/28*** | (2006.01) |
| ***H01Q 15/02*** | (2006.01) |
| ***H01Q 21/26*** | (2006.01) |

(56) References Cited

U.S. PATENT DOCUMENTS

| | | | | |
|---|---|---|---|---|
| 5,182,642 | A | 1/1993 | Gersdorff et al. | |
| 5,623,511 | A | 4/1997 | Bar-David et al. | |
| 5,831,977 | A | 11/1998 | Dent | |
| 5,872,542 | A | 2/1999 | Simons et al. | |
| 5,956,624 | A | 9/1999 | Hunsinger et al. | |
| 6,212,246 | B1 | 4/2001 | Hendrickson | |
| 6,289,063 | B1 | 9/2001 | Duxbury | |
| 6,356,555 | B1 | 3/2002 | Rakib et al. | |
| 6,388,621 | B1 | 5/2002 | Lynch | |
| 6,426,983 | B1 | 7/2002 | Rakib et al. | |
| 6,608,864 | B1 | 8/2003 | Strait | |
| 6,631,168 | B2 | 10/2003 | Izumi | |
| 6,704,366 | B1 | 3/2004 | Combes et al. | |
| 6,956,814 | B1 | 10/2005 | Campanella | |
| 7,010,048 | B1 | 3/2006 | Shattil | |
| 7,265,719 | B1 | 9/2007 | Moosbrugger et al. | |
| 7,327,812 | B2 | 2/2008 | Auer | |
| 7,392,018 | B1 | 6/2008 | Ebert et al. | |
| 7,689,049 | B2 | 3/2010 | Monro | |
| 7,773,685 | B2 | 8/2010 | Tirkkonen et al. | |
| 7,864,877 | B2 | 1/2011 | Hottinen | |
| 8,229,017 | B1 | 7/2012 | Lee et al. | |
| 8,259,845 | B2 | 9/2012 | Dent | |
| 8,401,131 | B2 | 3/2013 | Fety et al. | |
| 8,547,988 | B2 | 10/2013 | Hadani et al. | |
| 8,619,892 | B2 | 12/2013 | Vetter et al. | |
| 8,717,210 | B2 | 5/2014 | Eldar et al. | |
| 8,879,378 | B2 | 11/2014 | Rakib et al. | |
| 8,892,048 | B1 | 11/2014 | Turner | |
| 8,976,851 | B2 | 3/2015 | Hadani et al. | |
| 9,031,141 | B2 | 5/2015 | Hadani et al. | |
| 9,071,285 | B2 | 6/2015 | Hadani et al. | |
| 9,071,286 | B2 | 6/2015 | Hadani et al. | |
| 9,083,483 | B1 | 7/2015 | Rakib et al. | |
| 9,083,595 | B2 | 7/2015 | Rakib et al. | |
| 9,130,638 | B2 | 9/2015 | Hadani et al. | |
| 9,282,528 | B2 | 3/2016 | Hashimoto | |
| 9,294,315 | B2 | 3/2016 | Hadani et al. | |
| 9,444,514 | B2 | 9/2016 | Hadani et al. | |
| 9,548,840 | B2 | 1/2017 | Hadani et al. | |
| 9,553,984 | B2 | 1/2017 | Krause et al. | |
| 9,590,779 | B2 | 3/2017 | Hadani et al. | |
| 9,634,719 | B2 | 4/2017 | Rakib et al. | |
| 9,660,851 | B2 | 5/2017 | Hadani et al. | |
| 9,668,148 | B2 | 5/2017 | Hadani et al. | |
| 9,712,354 | B2 | 7/2017 | Hadani et al. | |
| 9,729,281 | B2 | 8/2017 | Hadani et al. | |
| 10,116,058 | B2 * | 10/2018 | Oh | H01Q 19/062 |
| 2001/0031022 | A1 | 10/2001 | Petrus et al. | |
| 2001/0033614 | A1 | 10/2001 | Hudson | |
| 2001/0046205 | A1 | 11/2001 | Easton et al. | |
| 2002/0001308 | A1 | 1/2002 | Heuer | |
| 2002/0034191 | A1 | 3/2002 | Shattil | |
| 2002/0181388 | A1 | 12/2002 | Jain et al. | |
| 2002/0181390 | A1 | 12/2002 | Mody et al. | |
| 2002/0181607 | A1 | 12/2002 | Izumi | |
| 2003/0073464 | A1 | 4/2003 | Giannakis et al. | |
| 2003/0185295 | A1 | 10/2003 | Yousef | |
| 2003/0235147 | A1 | 12/2003 | Walton et al. | |
| 2004/0044715 | A1 | 3/2004 | Aldroubi et al. | |
| 2004/0174812 | A1 | 9/2004 | Murakami et al. | |
| 2004/0189581 | A1 | 9/2004 | Sako et al. | |
| 2004/0196208 | A1 | 10/2004 | Schnaffner et al. | |
| 2004/0218523 | A1 | 11/2004 | Varshney et al. | |
| 2005/0157778 | A1 | 7/2005 | Trachewsky et al. | |
| 2005/0157820 | A1 | 7/2005 | Wongwirawat et al. | |
| 2005/0180517 | A1 | 8/2005 | Abe | |
| 2005/0207334 | A1 | 9/2005 | Hadad | |
| 2005/0251844 | A1 | 11/2005 | Martone et al. | |
| 2006/0008021 | A1 | 1/2006 | Bonnet | |
| 2006/0039270 | A1 | 2/2006 | Strohmer et al. | |
| 2007/0001918 | A1 * | 1/2007 | Ebling | H01Q 19/09 343/753 |
| 2007/0014272 | A1 | 1/2007 | Palanki et al. | |
| 2007/0038691 | A1 | 2/2007 | Candes et al. | |
| 2007/0078661 | A1 | 4/2007 | Sriram et al. | |
| 2007/0104283 | A1 | 5/2007 | Han et al. | |
| 2007/0110131 | A1 | 5/2007 | Guess et al. | |
| 2007/0211952 | A1 | 9/2007 | Faber et al. | |
| 2007/0237181 | A1 | 10/2007 | Cho et al. | |
| 2007/0253465 | A1 | 11/2007 | Muharemovic et al. | |
| 2007/0253504 | A1 | 11/2007 | Hasegawa | |
| 2008/0030416 | A1 * | 2/2008 | Lee | H01Q 5/42 343/753 |
| 2008/0043857 | A1 | 2/2008 | Dias et al. | |
| 2008/0117999 | A1 | 5/2008 | Kadous et al. | |
| 2008/0186843 | A1 | 8/2008 | Ma et al. | |
| 2008/0187062 | A1 | 8/2008 | Pan et al. | |
| 2008/0232504 | A1 | 9/2008 | Ma et al. | |
| 2008/0310383 | A1 | 12/2008 | Kowalski | |
| 2009/0080403 | A1 | 3/2009 | Hamdi | |
| 2009/0092259 | A1 | 4/2009 | Jot et al. | |
| 2009/0103593 | A1 | 4/2009 | Bergamo | |
| 2009/0122854 | A1 | 5/2009 | Zhu et al. | |
| 2009/0161804 | A1 | 6/2009 | Chrabieh et al. | |
| 2009/0204627 | A1 | 8/2009 | Hadani | |
| 2009/0222226 | A1 | 9/2009 | Baraniuk et al. | |
| 2009/0303961 | A1 | 12/2009 | Popovic et al. | |
| 2010/0001901 | A1 | 1/2010 | Baraniuk et al. | |
| 2010/0008432 | A1 | 1/2010 | Kim et al. | |
| 2010/0027608 | A1 | 2/2010 | Priotti | |
| 2010/0111138 | A1 | 5/2010 | Hosur et al. | |
| 2010/0142476 | A1 | 6/2010 | Jiang et al. | |
| 2010/0187914 | A1 | 7/2010 | Rada et al. | |
| 2010/0238787 | A1 | 9/2010 | Guey | |
| 2010/0277308 | A1 | 11/2010 | Potkonjak | |
| 2010/0303136 | A1 | 12/2010 | Ashikhmin et al. | |
| 2010/0322349 | A1 | 12/2010 | Lee et al. | |
| 2011/0007789 | A1 | 1/2011 | Garmany | |
| 2011/0110532 | A1 | 5/2011 | Svendsen | |
| 2011/0116489 | A1 | 5/2011 | Grandhi | |
| 2011/0116516 | A1 | 5/2011 | Hwang et al. | |
| 2011/0126071 | A1 | 5/2011 | Han et al. | |
| 2011/0131463 | A1 | 6/2011 | Gunnam | |
| 2011/0216808 | A1 | 9/2011 | Tong et al. | |
| 2011/0286502 | A1 | 11/2011 | Adachi et al. | |
| 2011/0287778 | A1 | 11/2011 | Levin et al. | |
| 2011/0292971 | A1 | 12/2011 | Hadani et al. | |
| 2011/0293030 | A1 | 12/2011 | Rakib et al. | |
| 2011/0299379 | A1 | 12/2011 | Sesia et al. | |
| 2011/0305267 | A1 | 12/2011 | Riu et al. | |
| 2012/0021769 | A1 | 1/2012 | Lindoff et al. | |
| 2012/0051457 | A1 | 3/2012 | Ma et al. | |
| 2012/0140716 | A1 | 6/2012 | Baldemair et al. | |
| 2012/0170684 | A1 | 7/2012 | Yim et al. | |
| 2012/0201322 | A1 | 8/2012 | Rakib et al. | |
| 2012/0213098 | A1 | 8/2012 | Sun | |
| 2012/0235795 | A1 | 9/2012 | Liao et al. | |
| 2012/0269201 | A1 | 10/2012 | Atungsiri et al. | |
| 2012/0272117 | A1 | 10/2012 | Stadelmeier et al. | |
| 2012/0320994 | A1 | 12/2012 | Loghin et al. | |
| 2013/0021977 | A1 | 1/2013 | Yang et al. | |
| 2013/0058390 | A1 | 3/2013 | Haas et al. | |
| 2013/0077579 | A1 | 3/2013 | Cho et al. | |
| 2013/0083661 | A1 | 4/2013 | Gupta et al. | |
| 2013/0121497 | A1 | 5/2013 | Smaragdis et al. | |
| 2013/0230010 | A1 | 9/2013 | Kim et al. | |
| 2013/0260787 | A1 | 10/2013 | Hashimoto | |
| 2013/0279627 | A1 | 10/2013 | Wu et al. | |
| 2013/0315133 | A1 | 11/2013 | Wang et al. | |
| 2014/0139370 | A1 | 5/2014 | Hamner et al. | |
| 2014/0143639 | A1 | 5/2014 | Loghin et al. | |
| 2014/0161154 | A1 | 6/2014 | Hadani et al. | |
| 2014/0169385 | A1 | 6/2014 | Hadani et al. | |
| 2014/0169406 | A1 | 6/2014 | Hadani et al. | |
| 2014/0169433 | A1 | 6/2014 | Hadani et al. | |
| 2014/0169436 | A1 | 6/2014 | Hadani et al. | |
| 2014/0169437 | A1 | 6/2014 | Hadani et al. | |

(56) References Cited

U.S. PATENT DOCUMENTS

| | | | | |
|---|---|---|---|---|
| 2014/0169441 | A1 | 6/2014 | Hadani et al. | |
| 2014/0247803 | A1 | 9/2014 | Arambepola et al. | |
| 2014/0348252 | A1 | 11/2014 | Siohan et al. | |
| 2014/0364128 | A1 | 12/2014 | Lee et al. | |
| 2015/0117395 | A1 | 4/2015 | Hadani et al. | |
| 2015/0326273 | A1 | 11/2015 | Rakib et al. | |
| 2015/0327085 | A1 | 11/2015 | Hadani et al. | |
| 2015/0382231 | A1 | 12/2015 | Jabbar et al. | |
| 2016/0043835 | A1 | 2/2016 | Hadani et al. | |
| 2016/0135132 | A1 | 5/2016 | Donepudi et al. | |
| 2016/0182269 | A1 | 6/2016 | Hadani et al. | |
| 2016/0191217 | A1 | 6/2016 | Hadani et al. | |
| 2016/0191280 | A1 | 6/2016 | Hadani et al. | |
| 2016/0254889 | A1 | 9/2016 | Shattil | |
| 2016/0277225 | A1 | 9/2016 | Frenne et al. | |
| 2016/0309345 | A1 | 10/2016 | Tehrani et al. | |
| 2016/0380743 | A1 | 12/2016 | Rakib | |
| 2016/0381576 | A1 | 12/2016 | Hadani et al. | |
| 2017/0012749 | A1 | 1/2017 | Rakib et al. | |
| 2017/0012810 | A1 | 1/2017 | Rakib et al. | |
| 2017/0019297 | A1 | 1/2017 | Rakib | |
| 2017/0033899 | A1 | 2/2017 | Rakib et al. | |
| 2017/0040711 | A1 | 2/2017 | Rakib et al. | |
| 2017/0062944 | A1 | 3/2017 | Zimmerman et al. | |
| 2017/0078054 | A1 | 3/2017 | Hadani et al. | |
| 2017/0099122 | A1 | 4/2017 | Hadani et al. | |
| 2017/0099607 | A1 | 4/2017 | Hadani et al. | |
| 2017/0149594 | A1 | 5/2017 | Rakib et al. | |
| 2017/0149595 | A1 | 5/2017 | Rakib et al. | |
| 2017/0201354 | A1 | 7/2017 | Hadani et al. | |
| 2017/0207817 | A1 | 7/2017 | Hadani et al. | |
| 2017/0222700 | A1 | 8/2017 | Hadani et al. | |
| 2017/0230215 | A1 | 8/2017 | Rakib et al. | |
| 2017/0244524 | A1 | 8/2017 | Hadani et al. | |
| 2018/0301803 | A1* | 10/2018 | Savage ..... | H01Q 21/0031 |

FOREIGN PATENT DOCUMENTS

| | | | |
|---|---|---|---|
| CN | 101939935 | A | 1/2011 |
| EP | 1432168 | A1 | 6/2004 |
| JP | 2011127910 | A | 6/2011 |
| WO | 2007004297 | | 1/2007 |
| WO | 2011137699 | A1 | 11/2011 |
| WO | 2011150315 | | 12/2011 |
| WO | 2013148546 | | 10/2013 |
| WO | 2014004585 | | 1/2014 |
| WO | 2016014596 | | 1/2016 |
| WO | 2016014598 | | 1/2016 |
| WO | 2016176642 | | 11/2016 |
| WO | 2016183230 | | 11/2016 |
| WO | 2016183240 | | 11/2016 |
| WO | 2016209848 | | 12/2016 |
| WO | 2017003952 | | 1/2017 |
| WO | 2017011478 | | 1/2017 |

OTHER PUBLICATIONS

Office Action for U.S. Appl. No. 13/117,119, dated Aug. 5, 2013, 5 pages.
Notice of Allowance for U.S. Appl. No. 13/117,119, dated Feb. 28, 2014, 13 pages.
Banelli, P. et al., "Modulation Formats and Waveforms for 5G Networks: Who Will Be the Heir of OFDM?," IEEE Signal Processing Magazine, vol. 81, pp. 80-93, Nov. 2014.
El Hattachi, R. et al., "NGMN 5G Initiative White Paper," NGMN Alliance, Feb. 17, 2015. [Online]. Available: https://www.ngmn.org/uploads/media/NGMN_5G_White_Paper_V1_0.pdf, 125 pages.
Rusek, F. et al., "Scaling Up MIMO, Opportunities and Challenges with Very Large Arrays," IEEE Signal Processing Magazine, pp. 40-60 (2013).
Vodafone, "Cellular Internet of Things: Architectural Aspects," RP-150869, 3GPP RAN#68, Malmo, Sweden (Jun. 9, 2015), 19 pages.
Supplementary European Search Report for European Application No. 11787483.4, dated Sep. 9, 2014, 6 pages.
International Search Report and Written Opinion for International Application No. PCT/US2011/038302, dated Nov. 15, 2011, 8 pages.
International Preliminary Report on Patentability for International Application No. PCT/US2011/038302, dated Dec. 4, 2012, 7 pages.
Office Action for U.S. Appl. No. 13/117,124, dated Feb. 22, 2013, 7 pages.
Notice of Allowance for U.S. Appl. No. 13/117,124, dated Aug. 8, 2013, 10 pages.
Office Action for U.S. Appl. No. 14/605,957, dated Jun. 22, 2017, 6 pages.
Supplementary European Search Report for European Application No. 13809004.8, dated Apr. 14, 2016, 8 pages.
Communication Pursuant to Article 94(3) EPC for European Application No. 13809004.8, dated Feb. 17, 2017, 5 pages.
Notice of Allowance for U.S. Appl. No. 13/927,087, dated Feb. 25, 2015, 9 pages.
Office Action for U.S. Appl. No. 13/927,087, dated Nov. 12, 2014, 14 pages.
Gurevich, S. et al. "Group Representation Design of Digital Signals and Sequences," S.W. Golomb et al. (eds.), SETA 2008, LNCS 5203, pp. 153-166, Springer-Verlag Berlin Heidelberg (2008).
International Search Report and Written Opinion for International Application No. PCT/US2013/047723, dated Oct. 29, 2013, 17 pages.
International Preliminary Report on Patentability for International Application No. PCT/US2013/047723, dated Dec. 31, 2014, 15 pages.
Notice of Allowance for U.S. Appl. No. 13/927,088, dated Feb. 18, 2015, 7 pages.
Office Action for U.S. Appl. No. 13/927,088, dated Nov. 28, 2014, 13 pages.
Notice of Allowance for U.S. Appl. No. 13/927,086, dated Dec. 26, 2014, 8 pages.
Supplemental Notice of Allowability for U.S. Appl. No. 13/927,086, dated Mar. 19, 2015, 4 pages.
Office Action for U.S. Appl. No. 13/927,086, dated Oct. 14, 2014, 10 pages.
Office Action for U.S. Appl. No. 13/927,089, dated Dec. 24, 2014, 13 pages.
Office Action for U.S. Appl. No. 13/927,089, dated Aug. 14, 2015, 7 pages.
Supplemental Notice of Allowability for U.S. Appl. No. 13/927,091, dated Jun. 11, 2015, 4 pages.
Notice of Allowance for U.S. Appl. No. 13/927,091, dated Apr. 24, 2015, 8 pages.
Office Action for U.S. Appl. No. 13/927,091, dated Jan. 27, 2015, 15 pages.
Office Action for U.S. Appl. No. 13/927,092, dated Oct. 8, 2014, 5 pages.
Notice of Allowance for U.S. Appl. No. 13/927,092, dated Oct. 24, 2014, 7 pages.
Office Action for U.S. Appl. No. 13/927,095, dated Apr. 30, 2015, 11 pages.
Office Action for U.S. Appl. No. 13/927,095, dated Nov. 4, 2015, 9 pages.
Office Action for U.S. Appl. No. 13/927,095, dated Jun. 1, 2016, 10 pages.
Office Action for U.S. Appl. No. 14/717,886, dated Apr. 19, 2016, 10 pages.
Office Action for U.S. Appl. No. 14/709,377, dated Dec. 11, 2015, 12 pages.
Office Action for U.S. Appl. No. 14/709,377, dated Jul. 13, 2016, 17 pages.
Examination Report No. 1 for Australian Application No. 2013239970, dated Dec. 8, 2015, 3 pages.
"AT&T Annual Report 2014," Opening Our Network [Online]. Retrieved from the Internet: Sep. 22, 2016. <URL: http://www.att.com/Investor/ATT_Annual/2014/att_introduces_new_concepts_for_telecom_network.html>, 5 pages.

(56) References Cited

OTHER PUBLICATIONS

Catt, "UL ACK/NACK transmission methods for LTE-A," 3GPP TSG RAN WG1 Meeting #60bis, R1-102453, Beijing, China, Apr. 12-16, 2010, 8 pages.
Toskala, A. et al., "Physical Layer," Chapter 5 In: "LTE for UMTS: OFDMA and SC-FDMA Based Radio Access," Holma, H. et al. (eds.), John Wiley & Sons, Ltd., United Kingdom, 2009, pp. 83-135.
Mecklenbrauker, W., "A Tutorial on Non-Parametric Bilinear Time-Frequency Signal Representations," In: Time and Frequency Representation of Signals and Systems, Longo, G. et al. (eds.), Springer-Verlag Wien, vol. 309, pp. 11-68 (1989).
Nehorai, A. et al., "MURI: Adaptive waveform design for full spectral dominance (2005-2010)," AFOSR FA9550-05-1-0443, Final Report, [online], Mar. 11, 2011 Retrieved on May 11, 2013, Retrieved from the Internet <URL: http://oai.dtic.mil/oai/oai?verb=getRecord &metadataPrefix=html&identifier=ADA565420>, 103 pages.
Office Action for Japanese Application No. 2015-518647, dated Jul. 7, 2015, 10 pages.
Office Action for U.S. Appl. No. 14/754,596, dated Apr. 19, 2016, 18 pages.
Office Action for U.S. Appl. No. 14/809,129, dated Jul. 19, 2016, 5 pages.
Office Action for U.S. Appl. No. 15/617,962, dated Sep. 6, 2017, 10 pages.
International Search Report and Written Opinion for International Application No. PCT/US2016/050825, dated Feb. 8, 2017, 12 pages.
International Search Report and Written Opinion for International Application No. PCT/US2016/052524, dated Dec. 20, 2016, 8 pages.
Office Action for U.S. Appl. No. 15/374,995, dated Aug. 7, 2017, 6 pages.
International Search Report and Written Opinion for International Application No. PCT/US2017/025797, dated Jun. 21, 2017, 6 pages.
International Search Report and Written Opinion for International Application No. PCT/US2016/030259, dated Aug. 4, 2016, 13 pages.
Office Action for U.S. Appl. No. 15/152,464, dated Apr. 6, 2017, 10 pages.
Examination Report No. 1 for Australian Application No. 2013280487, dated May 2, 2016, 3 pages.
International Search Report and Written Opinion for International Application No. PCT/US2016/031928, dated Oct. 7, 2016, 10 pages.
Office Action for U.S. Appl. No. 15/188,946, dated May 8, 2017, 14 pages.
International Search Report and Written Opinion for International Application No. PCT/US2016/038584, dated Sep. 26, 2016, 8 pages.
Office Action for U.S. Appl. No. 15/187,668, dated Feb. 16, 2017, 6 pages.
International Search Report and Written Opinion for International Application No. PCT/US2016/031909, dated Aug. 11, 2016, 13 pages.
Office Action for U.S. Appl. No. 15/194,494, dated May 5, 2017, 16 pages.
International Search Report and Written Opinion for International Application No. PCT/US2016/039662, dated Nov. 29, 2016, 14 pages.
Office Action for U.S. Appl. No. 15/436,653, dated Jun. 2, 2017, 10 pages.
Office Action for U.S. Appl. No. 15/208,545, dated Aug. 21, 2017, 15 pages.
International Search Report and Written Opinion for International Application No. PCT/US2016/041940, dated Oct. 20, 2016, 8 pages.
Supplementary European Search Report for European Application No. 13768150.8, dated Oct. 30, 2015, 7 pages.
International Search Report and Written Opinion for International Application No. PCT/US2013/033652, dated Jun. 12, 2013, 8 pages.
International Search Report and Written Opinion for International Application No. PCT/US2015/041417, dated Oct. 1, 2015, 7 pages.
Office Action for U.S. Appl. No. 14/805,407, dated Dec. 14, 2016, 7 pages.
International Search Report and Written Opinion for International Application No. PCT/US2015/041420, dated Oct. 1, 2015, 6 pages.

* cited by examiner $$\varepsilon_r = 2 - (r/a)^2$$

where $r$ is the distance from the center of the lens to an interior point, a is the outer radius of the lens and $\varepsilon_r$ is the relative dielectric constant at r.

LOW COST ELECTROMAGNETIC FEED NETWORK

CROSS REFERENCE TO RELATED APPLICATION

This patent document is a 371 National Phase Application of PCT Application No. PCT/US2018/052026 entitled "LOW COST ELECTROMAGNETIC FEED NETWORK" filed on Sep. 20, 2018 which claims the benefit of priority U.S. Provisional Patent Application No. 62/560,787, filed on Sep. 20, 2017. The entire content of the before-mentioned patent application is incorporated by reference as part of the disclosure of this document.

TECHNICAL FIELD

The present document relates to antenna design and operation, and more particularly to lens antennas.

BACKGROUND

Due to an explosive growth in the number of wireless user devices and the amount of wireless data that these devices can generate or consume, current wireless communication networks are fast running out of bandwidth to accommodate such a high growth in data traffic and provide high quality of service to users.

Various efforts are underway in the telecommunication industry to come up with next generation of wireless technologies that can keep up with the demand on performance of wireless devices and networks.

SUMMARY

This document discloses low cost electromagnetic feed network design and fabrication and use in a lens antenna.

In one example aspect, an antenna system is disclosed. The antenna system includes a lens portion that has a spherical surface. The antenna system also includes an antenna feed structure coupled to a surface of the lens portion. The antenna feed structure includes one or more feed tiles supported by an electrical connectivity layer conforming to the spherical surface. The antenna feed structure may include one or more offset structures positioned between the one or more feed tiles and an outer surface of the antenna system.

In yet another example aspect, a method of manufacturing a lens antenna is disclosed. The method includes fabricating a lens portion that comprises a curved surface and fabricating a feed network for positioning on the curved surface. The fabrication of the feed network includes fabricating an integrated planar layer comprising a flexible layer of an electrically conductive layer and a rigid layer of antenna tiles, and processing the integrating planar layer at a depth from surface such that the rigid layer is cut into corresponding antenna tiles without cutting the flexible layer. The method further includes positioning the integrated planar layer on a curved surface of the lens portion such that the flexible layer conforms to the curved surface and the antenna tiles each are tangential to the curved surface.

In yet another aspect, an antenna feed network is disclosed. The antenna feed network includes a plurality of antennas, where each antenna includes at least two portions coupled to each other via an electrical contact that includes a signal contact and a ground contact. The dipole antenna are coplanar in a plane. The antenna feed network also includes a transmission line placed perpendicular to the plane and electrically coupled to each of the plurality of antennas at a signal contact portion and a ground contact portion.

These, and other, features are described in this document.

DESCRIPTION OF THE DRAWINGS

Drawings described herein are used to provide a further understanding and constitute a part of this application. Example embodiments and illustrations thereof are used to explain the technology rather than limiting its scope.

DETAILED DESCRIPTION

To make the purposes, technical solutions and advantages of this disclosure more apparent, various embodiments are described in detail below with reference to the drawings. Unless otherwise noted, embodiments and features in embodiments of the present document may be combined with each other.

Section headings are used in the present document, including the appendices, to improve readability of the description and do not in any way limit the discussion to the respective sections only. Unless otherwise noted, abbreviations and concepts used in the present document.

Figure 1:
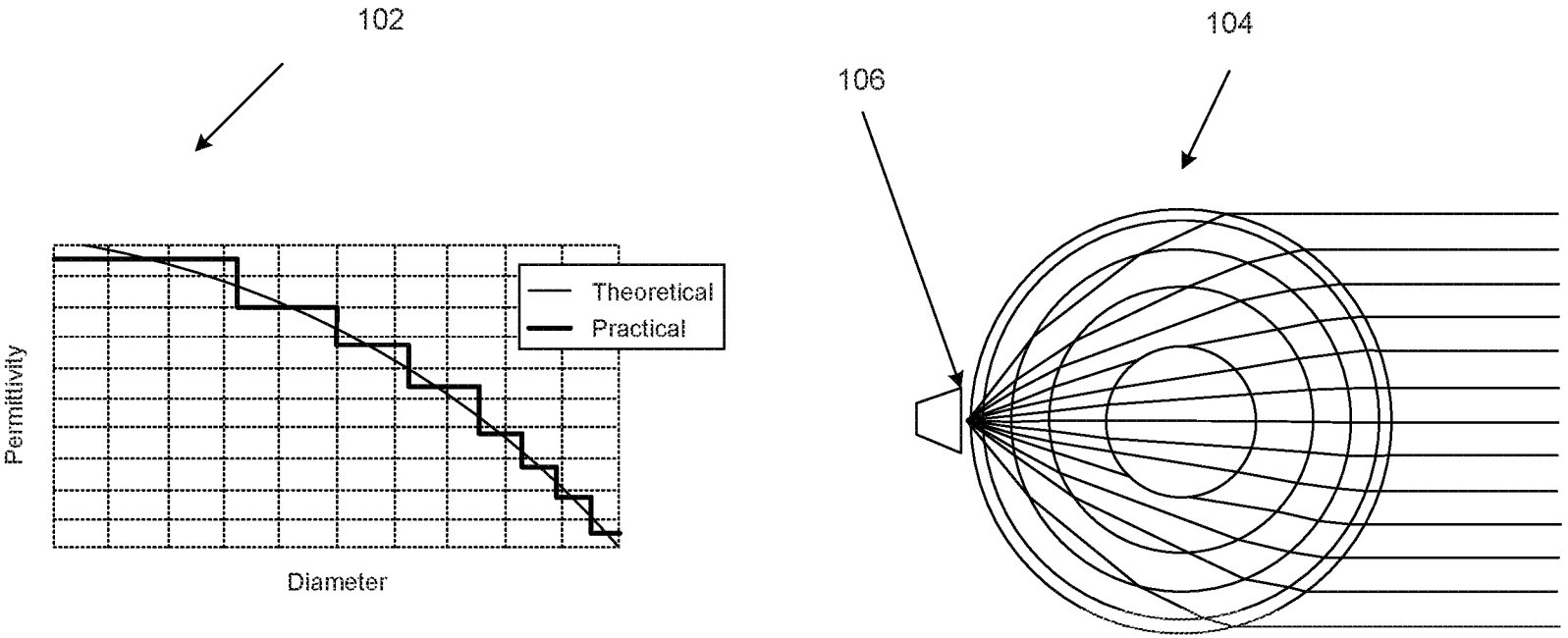
FIG. 1 shows an example of a Luneburg lens.

FIG. 1 shows an example of a Luneburg lens. The graph 102 shows an example in which the dielectric constant of an RF lens is plotted along vertical axis as a function of diametrical distance from the center plotted along the horizontal axis. The diagram 104 pictorially shows how the RF lens can achieve focusing of RF energy at a focal point 106 of the lens. Therefore, it is desirable to place an antenna element for transmitting or receiving RF signals using a lens RF antenna.

Figure 2:
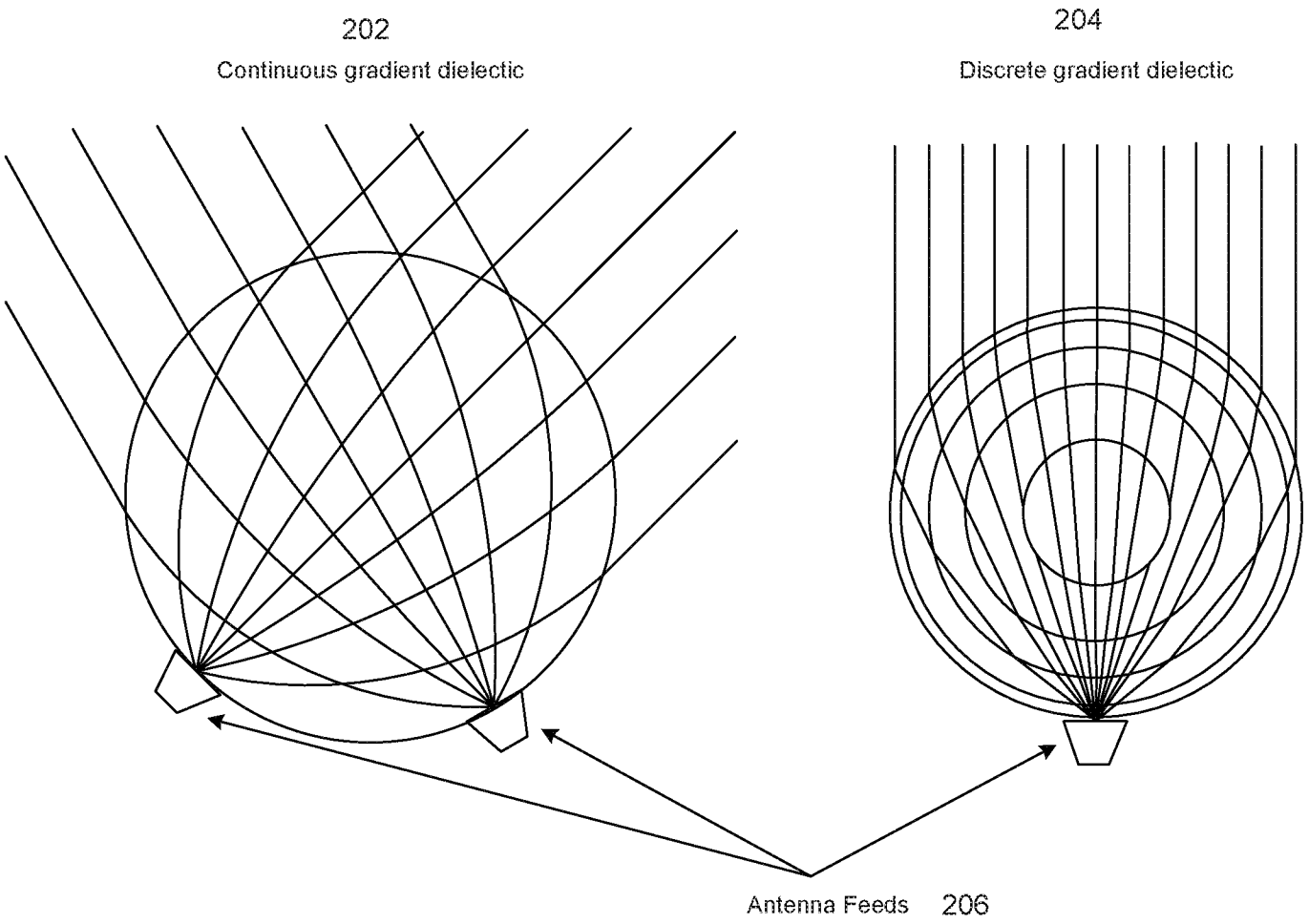
FIG. 2 shows examples of Luneburg lenses.

FIG. 2 shows examples of RF lens antennas. Two examples are shown. The lens diagram 202 shows an example of a continuous dielectric gradient lens. The example 204 shows an example of a lens that comprises discrete dielectric layers. In both embodiments, example placements of antenna feed are shown. Due to curved surfaces of the lens, the antenna feeds 206 should also conform to the curved surface to avoid performance loss. Thus, for effective operation, antenna feed elements need to be positioned along a curved surface (within a specified tolerance) to provide multi-beam joint performance characteristics.

Feed Network Fabrication

One challenge faced in the fabrication and operation of an RF lens is the precision of alignment that should be achieved for controlling the radiative pattern of the antenna. Therefore, manufacturing and assembly of a multi-feed network is a challenge. Antenna feeds have significant thickness, either due to resonator cavity construction or the need for transmission lines to carry signal away from surface feeds (like a dipole antenna). Positioning one or more antenna feeds onto curved surface is problematic.

One possible solution is to fabricate monolithic feed network with an integrated flexible layer of connectivity between feeds. For example, in some fabrication processes, a post fabrication cutting instrument may be used to separate rigid antenna "tiles" without cutting through flexible layer.

Often, the flexible layer has an integrated ground plane to serve as a shield for reflections and off-axis RF excitement as well as to provide a low inductance plus resistance ground reference to prevent ground loops.

In some embodiments, a flat monolithic feed network may be used due to compatibility with existing low-cost fabrication equipment.

One example fabrication process may include the following.

First, construct "tiles" of antenna elements and use a flexible interconnect between tiles to allow to conform to curved surface. The interconnect can be discrete signal lines but more often this flexible layer has an integrated ground plane to serve as a shield for reflections and off-axis RF excitement as well as to provide a low inductance plus resistance ground reference to prevent ground loops.

In an example monolithic embodiment, the process may include the following steps: First, fabricate monolithic feed network with an integrated flexible layer of connectivity between feeds. Next, use post fabrication cutting instrument to separate rigid antenna "tiles" without cutting through flexible layer.

In another example embodiment, called discrete embodiment, the following steps may be performed: First, fabricate individual tiles and attach tiles to flexible interconnect via industry standard practices (including alignment jig or pick-and-place methods).

Example Advantages

Assembly of feed network is performed in a planar manner to due to compatibility with existing low-cost fabrication equipment. Planar feed network is subsequently wrapped around curved/uneven surface.

Tiles are constructed in repeatable manner in either embodiment which allows for low cost manufacturing compatible with automation.

Figure 3:
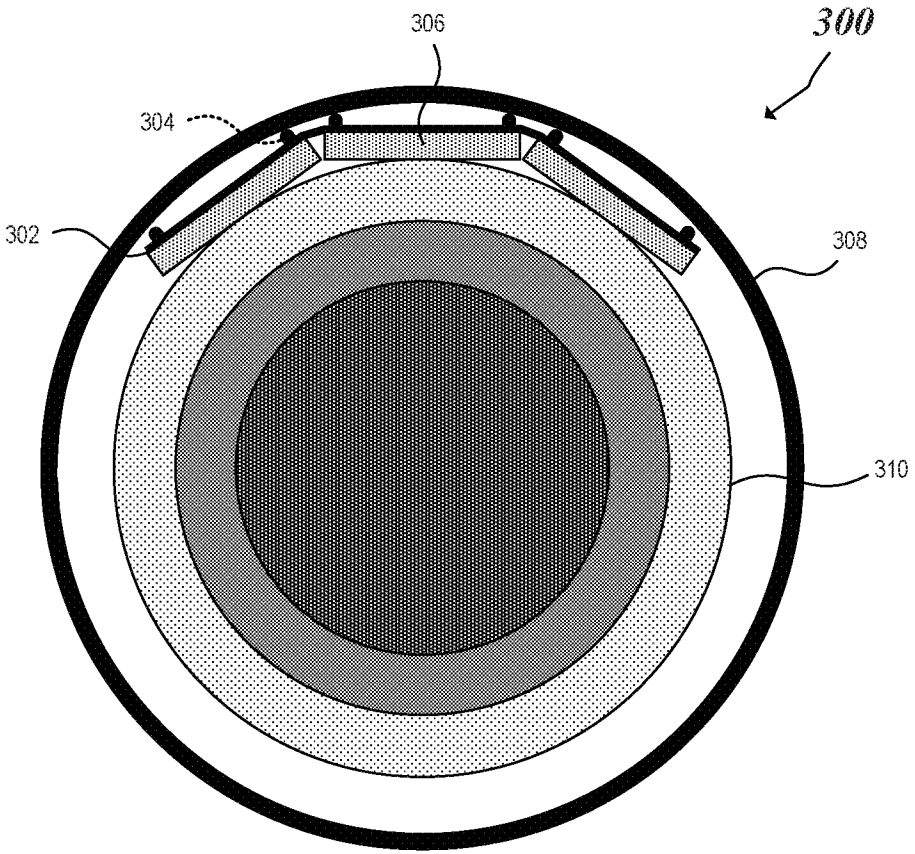
FIG. 3 shows an example feed network and a tile arrangement.

FIG. 3 shows an example of an RF lens 300 that includes a feed network and a tile arrangement. Feed tiles 306 may be organized in a curved region on an outer surface of an electromagnetic (EM) lens 310 that forms an inner surface of the RF lens 300. There may be anywhere between 1 to N feed tiles 306, where N is an integer. RF lens 300 depicts an example when N=3. Individual feed tiles 306 may be substantially planar, and may be positioned to collectively form a curved arrangement. Each tile 306 may come in contact with the outer surface 308 to conform to a plane tangential to the line of contact. For example, the outer surface 308, or radome, may be designed to be of a size that applies force to the tiles to keep them in place and in turn be in contact with the inner surface 310 at midpoints between all contact points with the outer surface. Antenna elements (not shown) within each tile 306 may be fabricated relative to the inner contact point of each tile (where the tile is in contact with the inner surface). The contact area may be at the center of the tile 306. Each tile may be rectangular planar and made of a rigid material.

Offset structures 304 may be positioned between the feed tiles 306 on the inside of an outer surface 308 (radome) of the RF lens 300. One use of the offset structure may be to adjust the tangential positions of the tiles 306. Another function of the offset structures 304 may be to provide a low frictional contact with the radome, thus increasing the operation efficiency of the RF lens 300. Another use of the offset structures 304 may be to provide height offset to allow for components to be mounted on the rigid tile 306, for example to allow for mounting of silicon chips. The offset structures 304 may help incorporate some level of compression compliance to allow for manufacturing tolerances of inner and outer surfaces as well as dimensions of tiles and placement of offset structures on tile. In some embodiments, the offset structures 404 may be spherical with the size suitable to achieve the above-discussed uses.

In some embodiments, a silicon foam material (not shown) may be used for the offset structures 304. In general, a material that is compressible and shock absorbing may be used. The material may be non-conductive and provide electromagnetic isolation to ensure that signals being transmitted or received by each tile 306 do not corrupt each other.

A layer 302 may be positioned between the offset structures 304 and the feed tiles 306 to provide electrical connectivity to the feed tiles 306. The layer 302 may be made of a flexible material such as a flexible printed circuit board. The layer 302 may be monolithic throughout the curved surface area covered by the feed tiles 306. In some embodiments, the combined thickness (in radial direction) of the layer 302 and the feed tiles 306 may be about 0.75 inches.

The EM lens 310 may be made up of different dielectric material to provide gradient for convergence of electromagnetic signals, e.g., as depicted in the examples in FIG. 3. While the depicted lens in FIG. 3 is similar to the discrete gradient dielectric structure depicted in FIG. 2, in some embodiments, a continuous gradient dielectric structure may also be used.

Examples of Outer Surface of Rigid Tiles

The rigid tiles 306 may have imaginary (or real) concentric curved surfaces that will align rigid tiles to tangential contact point of inner curved surface. Planar contact point with inner surface may be at center of rigid tile 306. The outer surface contact is at multiple places and will reside at edges/corners of rigid tile (assuming a flat tile). Incorporation of registration/offset structures, which are optional, onto outer surface of rigid tile can manipulate alignment.

In one advantageous aspect, this structure provides low friction contact points with outer curved surface. In another advantageous aspect, this structure provide height offset to allow for components to be mounted on rigid tile. For example, this may provide working space to allow for mounting of silicon chips.

Examples of Placement of Transmission Lines

Antenna feeds, such as a dipole patch antenna, should transfer their high speed signals away from their focal plane with minimal cross-talk and minimal loss. Ideally, the signals should not be transferred in the same focal plane as the antenna feeds since they will be subject to cross talk and the leads may act like antenna elements themselves. In some embodiments described herein, the signals typically are transferred beyond the field strength of the antenna feeds. This distance is larger than the traditional designs via height capabilities of conventional circuit board manufacturing.

Conventional solutions that use multiboard stackups with connected vias result in jogs which impact the ability of the vias to act as transmission lines and also incur reduced reliability and increased cost. Another possible design of transmission lines may impose specific dielectric constants and require the use of low loss materials for circuit boards to enable transmission lines. However, such designed may suffer from a drawback of increased cost and reduced number of options for the manufacturing material.

Figure 4:
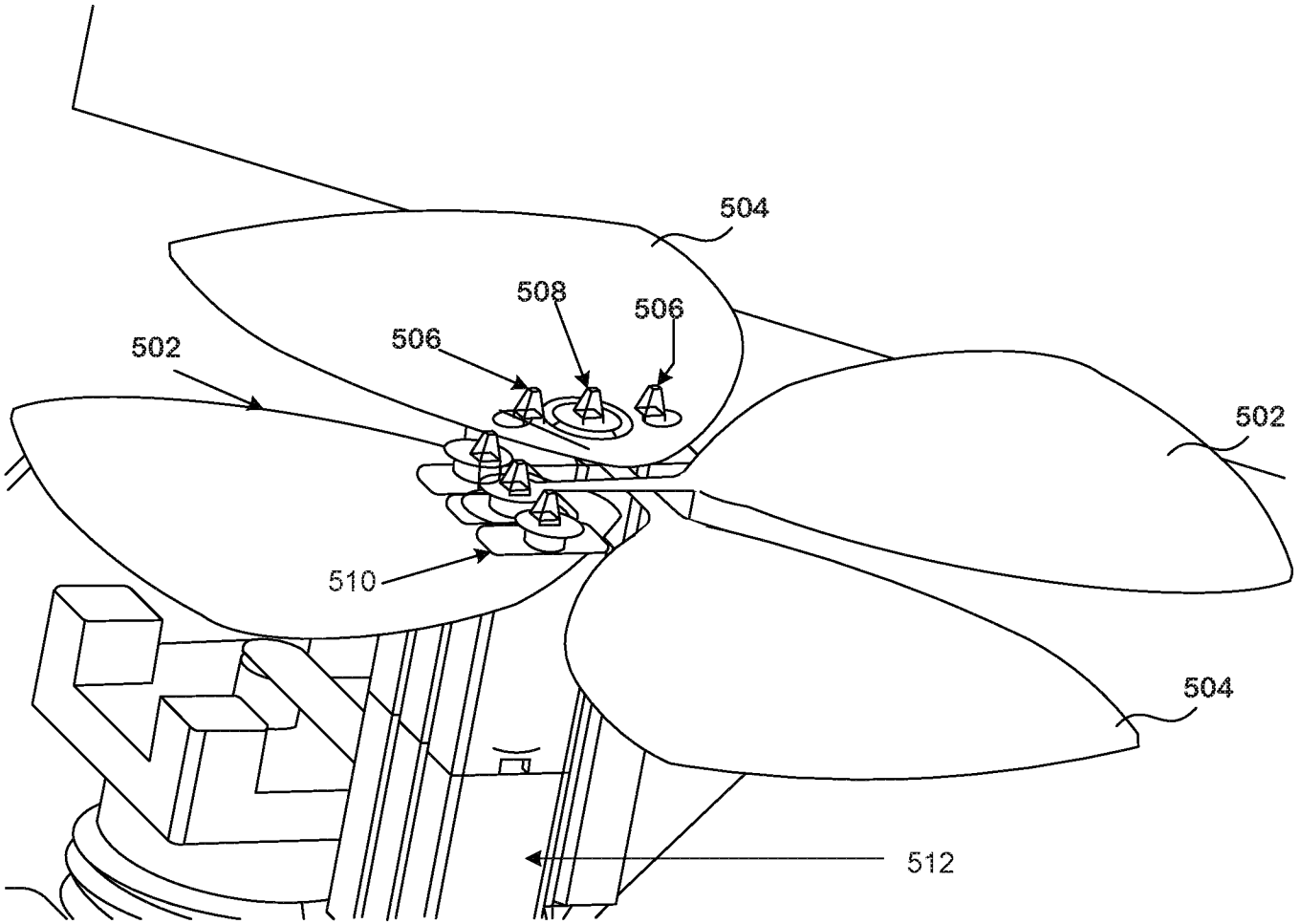
FIG. 4 shows details of antenna feed connection in an example embodiment.

FIG. 4 shows details of antenna feed connection in an example embodiment. Two dipole antennas 502 and 504 are shown. These dipole antennas 502 and 504 may be similar to each other, and the antenna 502 one visible side, while the other antenna 504 shows the back side of the structure. The two poles, or petals, of the antenna 502, 504 may be coupled to each other via contacts 506 and 508. The region 510 shows the back side of the contact region comprising contacts 506 and 508. A transmission line 512 may be coupled to the contacts 506, 508. While the depicted arrangement in FIG. 4 has three contact points in a linear ("stripline") formation (two end point contacts 506, and one middle contact 508), other geometrical patterns are possible. In general, the geometric arrangement includes one ground pin and one signal pin. For example, in some embodiments, the signal and ground pins may be placed to be coaxial to each other.

In FIG. 4, the transmission line 512 is positioned to be in a direction that is substantially orthogonal to the planes in which the dipoles 502 and 504 are located. As discussed in the present document, such a placement of transmission line minimized electromagnetic interference.

Figure 5:
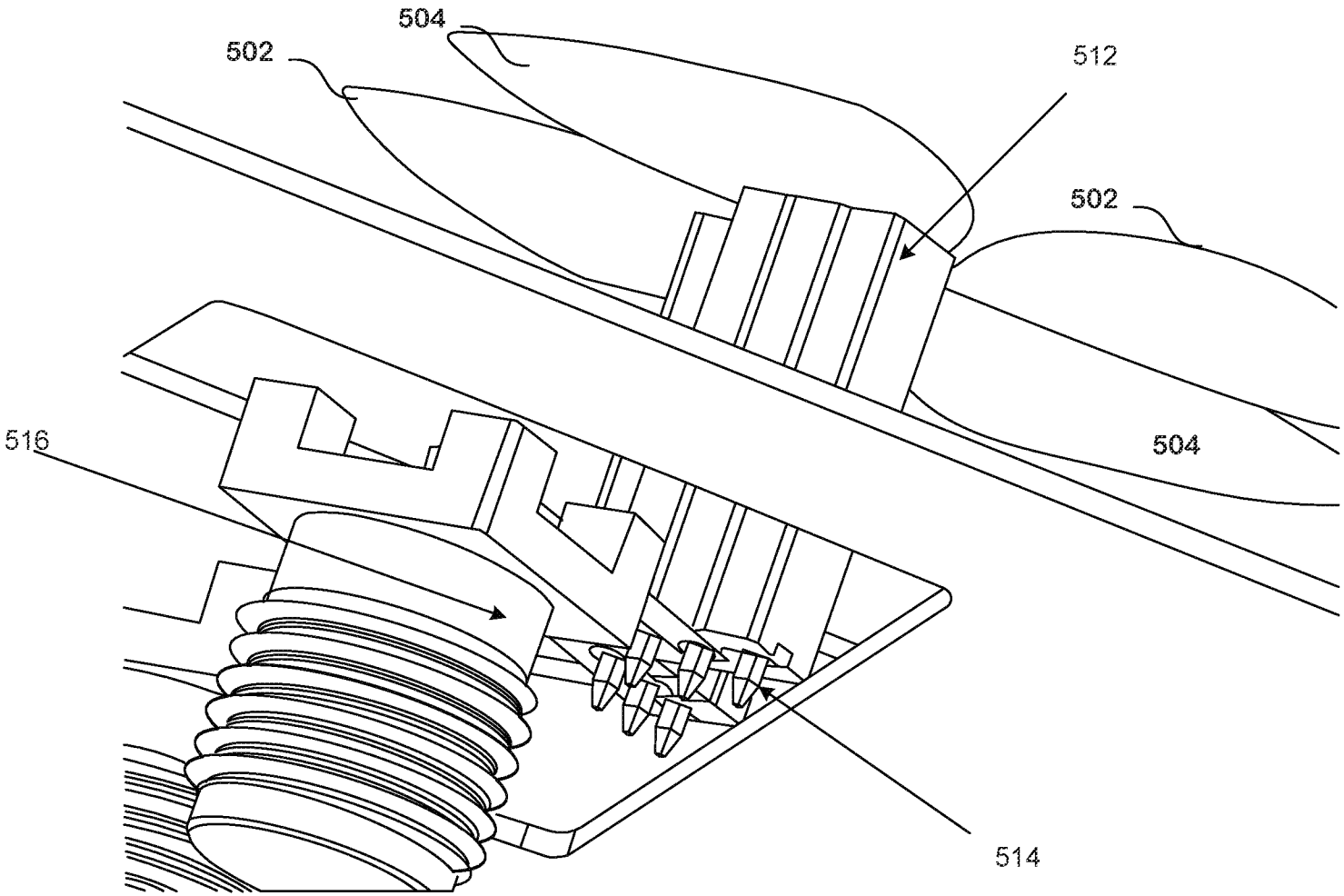
FIG. 5 shows example placement of transmission lines.

FIG. 5 shows example placement of transmission line 512 from a different angle. As can be seen the contact points 506, 508 and 510 are connected to the transmission line 512. As depicted from the different angle, the transmission line 512 is in electrical contact with the two petals of the dipole antennas 502 and 504 on the antenna side. The base side of the transmission line is connected at base contact points 514 to a platform 516 that provides a mounting point for mounting the antenna. The base side of transmission lines 512 that run from the contact points of each petal of antennas may have one or more ground pins as contacts and one or more signal pins as contacts (a single pin for each is depicted in FIG. 5). The platform 516 may be mechanically sturdy to provide a secure installation of the antenna structure. The pin contacts may be performed by simply inserting the pins into the corresponding contact surface.

In one advantageous aspect, the above described RF lens design can leverage high-volume production manufacturing techniques to reduce cost and risk. Other advantageous aspect that make the design and fabrication of the antenna easy include (1) easy assembly including placement of pins, boards, and daughter boards, (2) possibility of using injection molding of pin spacers, (3) no strict tolerances on soldering of components, and (4) possibility of using high volume pin header components to reduce cost.

Furthermore, in another advantageous aspect, the dimensions and composition of pin header spacers to create vertical transmission line can be tuned for performance independently from the rest of the implementation. Cost savings can be obtained from limiting materials to only area/volume needed to create transmission line.

In another advantageous aspect, orthogonal pin header orientation provides a rigid support for the layers which can reduce or remove the need for additional support (stand-offs, silicon foam, additional pin headers, etc.)

In yet another advantageous aspect, the design avoids the use of long through-board vias and/or multiple boards with through-board vias, which typically mean expensive board compositions to emulate vertical strip line.

Accordingly, in some embodiments, an antenna system is disclosed. The antenna system includes a lens portion that has a spherical surface. In some embodiments, the lens portion may be made up of material with a continuously varying dielectric constant. Alternatively, or in addition, the lens portion may include multiple concentric layers having progressively varying dielectric constants.

The antenna system includes an antenna feed structure coupled to a surface of the lens portion. The antenna feed structure includes one or more feed tiles supported by an electrical connectivity layer conforming to the spherical surface. In some embodiments, the electrical connectivity layer may be positioned to extend as an undersurface for all of the feed tiles.

The antenna feed structure includes one or more offset structures positioned between the one or more feed tiles and an outer surface of the antenna system. In some embodiments, the offset structures may be made from a dielectric material that is resonant at desired frequency band or wavelengths of the radio frequency signal transmitted or received using the antenna system. In some embodiments, the dielectric material may have a low loss to maximize the gain while receiving/transmitting the desired wavelengths. For example, the dielectric material may have a loss in the range of Between 0.0005-0.002 loss tangent. For example, the dielectric constant may be in the range 2.3 to 3.3 relative to vacuum.

Figure 6:
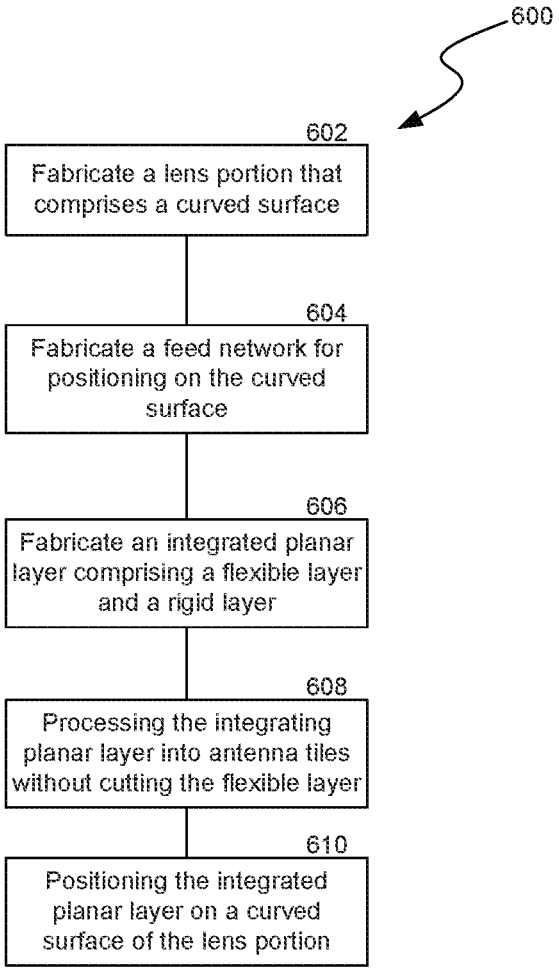
FIG. 6 shows a flowchart for an example of an antenna fabrication process.

As depicted by the example in FIG. 6, a method 600 of manufacturing a lens antenna includes fabricating (602) a lens portion that comprises a curved surface and fabricating (604) a feed network for positioning on the curved surface. The fabrication operation 604 of the feed network includes fabricating (606) an integrated planar layer comprising a flexible layer of an electrically conductive layer and a rigid layer of antenna tiles, and processing (608) the integrating planar layer at a depth from surface such that the rigid layer is cut into corresponding antenna tiles without cutting the flexible layer.

The method 600 further includes positioning (610) the integrated planar layer on a curved surface of the lens portion such that the flexible layer conforms to the curved surface and the antenna tiles each are tangential to the curved surface.

In some embodiments, the rigid layer of antenna tiles may be made up of materials capable of supporting low loss and resonance at the frequencies desired. The method may further include using pins to connect them between the layers, soldering them between each flex layer per tile, one for each polarization, to provide mechanical stability.

In some embodiments, the method 600 further includes placing offset structures touching a surface of antenna tiles that is opposite to a surface in contact with the flexible layer acting as a ground layer. In some embodiments, silicon foam, or another dielectric material as disclosed above, may be used to provide support for rigidity between different layers of the feed network. As described above, antenna tiles may be made up of low loss material and may be resonant in the desired frequencies of operation. In some embodiments, the method 600 includes connecting the antenna tiles using pins between layers. In some embodiments, at least one pin may be used for each polarization (and preferably 2 pins may be used). In some embodiments, the antenna tiles may be soldered between each flexible layer for each tile. The offset material may be selected to be a dielectric material that allows for low loss and dielectrically matched impedance for a resonant tiled antenna design.

In some embodiments, an antenna feed network includes a plurality of antennas, wherein each antenna includes at least two portions coupled to each other via an electrical contact that includes a signal contact and a ground contact. The plurality of dipole antenna is coplanar in a plane. A transmission line is placed perpendicular to the plane and electrically coupled to each of the plurality of antennas at a signal contact portion and a ground contact portion. These contact points are designed as pins, with a tapering end (e.g., conical or pyramidical) that makes it convenient to simply push the contact pin into the surface with which a secure electrical contact is to be established. Some embodiments are disclosed with respect to FIG. 4 and FIG. 5.

For example, in some embodiments, the ground contact portion includes a first ground contact point and a second ground contact point. The signal contact portion, the first ground contact point and the second ground contact point are linearly arranged in a single line along the antenna petal spread. In some embodiments, the ground contact portion is structured to encircle the signal contact portion such as by coaxially organizing the ground contact portion around the signal contact portion. In one advantageous aspect, such an arrangement may provide further electromagnetic isolation to the signal propagating via the signal contact.

In some embodiments, the transmission line may be etched into the ground plane. In some embodiments, additional strip lines may be provided in the ground plane of the antenna system, thereby allowing mechanical leeway or freedom for displacement of connectors of each tile. Such an arrangement, for example, ensures that antenna is able to absorb shocks and mechanical vibrations without losing its electrical operational performance.

While this patent document contains many specifics, these should not be construed as limitations on the scope of an invention that is claimed or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Only a few examples and implementations are disclosed. Variations, modifications, and enhancements to the described examples and implementations and other implementations can be made based on what is disclosed.

What is claimed is:

1. An antenna system, comprising:

a spherical lens including an inner curved surface and an outer curved surface; and an antenna feed structure coupled to the inner curved surface wherein a transmission line is positioned to be in a direction orthogonal to the inner curved surface, the antenna feed structure including:

one or more feed tiles supported by an electrical connectivity layer conforming to the spherical lens, wherein the electrical connectivity layer is connected to the transmission line using at least three pin contacts, one of the at least three pin contacts being a ground pin and another of the at least three pin contacts being a signal pin, and one or more offset structures positioned between the one or more feed tiles and the outer curved surface, wherein the one or more offset structures comprise a dielectric material that is resonant and has a low loss having between 0.0005 to 0.002 loss tangent to maximize gain at wavelengths of desired frequency bands of operation.

2. The antenna system of claim 1, wherein the one or more feed tiles are made from a material having a low loss and are resonant at desired frequencies.

3. The antenna system of claim 1, wherein the one or more feed tiles are connected to an outer surface of the antenna system using one or more of the at least three pin contacts.

4. The antenna system of claim 1, wherein the spherical lens comprises (a) a material with a continuously varying dielectric constant or (b) multiple concentric layers having progressively varying dielectric constants.

5. The antenna system of claim 1, wherein the electrical connectivity layer extends as an undersurface for all of the one or more feed tiles.

6. An antenna system, comprising:

a spherical lens including an inner curved surface and an outer curved surface; and an antenna feed structure coupled to the inner curved surface wherein a transmission line is positioned to be in a direction orthogonal to the inner curved surface, the antenna feed structure including:

one or more feed tiles supported by an electrical connectivity layer conforming to the spherical lens, wherein the electrical connectivity layer is connected to the transmission line using at least three pin contacts, one of the at least three pin contacts being a ground pin and another of the at least three pin contacts being a signal pin, and one or more offset structures positioned between the one or more feed tiles and the outer curved surface, wherein each of the one or more offset structures is made from a material that is compressible, non-conductive, and shock absorbing.

7. The antenna system of claim 6, wherein the material is a silicon foam material.

8. The antenna system of claim 6, wherein the spherical lens comprises (a) a material with a continuously varying dielectric constant or (b) multiple concentric layers having progressively varying dielectric constants.

9. The antenna system of claim 6, wherein the electrical connectivity layer extends as an undersurface for all of the one or more feed tiles.

10. The antenna system of claim 6, wherein the one or more feed tiles are connected to an outer surface of the antenna system using one or more of the at least three pin contacts.

11. An antenna system, comprising:

a spherical lens including an inner curved surface and an outer curved surface; and an antenna feed structure coupled to the inner curved surface wherein a transmission line is positioned to be in a direction orthogonal to the inner curved surface, the antenna feed structure including:

one or more feed tiles supported by an electrical connectivity layer conforming to the spherical lens, wherein the electrical connectivity layer is connected to the transmission line using at least three pin contacts, one of the at least three pin contacts being a ground pin and another of the at least three pin contacts being a signal pin, and one or more offset structures positioned between the one or more feed tiles and the outer curved surface, wherein at least one silicon chip is mounted on at least one of the one or more feed tiles.

12. The antenna system of claim 11, wherein the spherical lens comprises (a) a material with a continuously varying dielectric constant or (b) multiple concentric layers having progressively varying dielectric constants.

13. The antenna system of claim 11, wherein the electrical connectivity layer extends as an undersurface for all of the one or more feed tiles.

14. The antenna system of claim 11, wherein the one or more feed tiles are made from a material having a low loss and are resonant at desired frequencies.

15. The antenna system of claim 11, wherein the one or more feed tiles are connected to an outer surface of the antenna system using one or more of the at least three pin contacts.

16. An antenna system, comprising:

a spherical lens including an inner curved surface and an outer curved surface; and an antenna feed structure coupled to the inner curved surface wherein a transmission line is positioned to be in a direction orthogonal to the inner curved surface, the antenna feed structure including:

one or more feed tiles supported by an electrical connectivity layer conforming to the spherical lens, wherein the electrical connectivity layer is connected to the transmission line using at least three pin contacts, one of the at least three pin contacts being a ground pin and another of the at least three pin contacts being a signal pin, and one or more offset structures positioned between the one or more feed tiles and the outer curved surface, wherein the electrical connectivity layer is a made from a flexible material, wherein a combined thickness of the electrical connectivity layer and the one or more feed tiles is substantially 0.75 inches.

17. The antenna system of claim 16, wherein the flexible material is a flexible printed circuit board.

18. The antenna system of claim 16, wherein the spherical lens comprises (a) a material with a continuously varying dielectric constant or (b) multiple concentric layers having progressively varying dielectric constants.

19. The antenna system of claim 16, wherein the electrical connectivity layer extends as an undersurface for all of the one or more feed tiles.

20. The antenna system of claim 16, wherein the one or more feed tiles are made from a material having a low loss and are resonant at desired frequencies.

21. The antenna system of claim 16, wherein the one or more feed tiles are connected to an outer surface of the antenna system using one or more of the at least three pin contacts.

* * * * *